United States Patent [19]

Heitz et al.

[11] Patent Number: 4,648,322

[45] Date of Patent: Mar. 10, 1987

[54] PROPULSION AND DIRECTIONAL CONTROL MECHANISM FOR AN UNDERWATER DEVICE

[75] Inventors: Steven A. Heitz; Daniel R. Dobbs, both of Rockford, Ill.

[73] Assignee: Sundstrand Corporation, Rockford, Ill.

[21] Appl. No.: 751,507

[22] Filed: Jul. 2, 1985

[51] Int. Cl.[4] ..... F42B 19/01; F42B 19/18

[52] U.S. Cl. ..... 102/411; 114/338; 114/20.1

[58] Field of Search ..... 102/411, 399; 114/20 R, 114/20 A, 337, 338

[56] References Cited

U.S. PATENT DOCUMENTS

| | | | |
|---|---|---|---|
| 1,044,543 | 11/1912 | Leavitt | 114/20 |
| 1,349,969 | 8/1920 | Leathers | 114/20 |
| 2,851,982 | 9/1958 | Fogarty | 114/23 |
| 2,906,227 | 9/1959 | Smith | 114/20 |
| 3,148,508 | 9/1964 | Karig | 60/64 |
| 3,160,026 | 12/1964 | Rosen | 74/410 |
| 3,608,509 | 9/1971 | Brooks et al. | 114/23 |
| 4,274,333 | 6/1981 | Lampton | 102/411 |

FOREIGN PATENT DOCUMENTS

| | | | |
|---|---|---|---|
| 858214 | 1/1956 | Fed. Rep. of Germany | 114/338 |

*Primary Examiner*—Charles T. Jordan

*Attorney, Agent, or Firm*—Wood, Dalton, Phillips, Mason & Rowe

[57] ABSTRACT

A propulsion mechanism for an underwater device and, more particularly, a mobile mine having directional control provided by a pair of positionable fins each independently positionable by an associated fluid cylinder having a piston rod extending therefrom with a rack engaging with a pinion gear on a rotatable shaft supporting the fin. Control valve structure independently controls delivery of fluid under pressure to the two fluid cylinders for separate movement of the fins to produce the desired direction of travel. The propulsion mechanism utilizes a gas turbine which is supplied with hot gas under pressure from a gas propellant chamber which burns solid fuel and the gas turbine is located to enable substantially straight flow-through of gas from the gas propellant chamber through the turbine and through a tubular propeller shaft for exhaust aft of the mobile mine. The gas turbine has a turbine wheel with an axis of rotation offset from the axis of rotation of the propeller shaft and a speed-reduction gearbox is connected between the turbine wheel and the propeller shaft and with the bearing means for supporting the rotating components of the gas turbine, the speed-reduction gearbox and the propeller shaft being mounted to a common, rigid mounting structure in the form of a tail cone to assure accurate bearing alignment for the rotating components.

22 Claims, 4 Drawing Figures

PROPULSION AND DIRECTIONAL CONTROL MECHANISM FOR AN UNDERWATER DEVICE

DESCRIPTION

1. Technical Field

This invention pertains to propulsion and directional control mechanism for an underwater device and, more particularly, to such mechanism for a mobile mine. A gas propellant tank delivers propellant gas to a turbine engine which is connected to a propeller for rotation thereof through a speedreduction gearbox. Directional control means includes a pair of movable fins and an actuation system therefor. The components are integrated in a relation to provide a minimum size and maximum performance with optimized structural relations.

2. Background Art

There is considerable prior art relating to propulsion systems for underwater devices, particularly torpedoes. Known propulsion systems have used a fluid under pressure, steam or electricity as a power source. It is also generally known to generate a hot gas for driving a gas turbine by burning a solid propellant. This prior art has not associated a gas propellant tank or chamber with a gas turbine having a common wall with nozzles for directing gas from the chamber to the turbine and with a turbine wheel offset from the axis of rotation of a tubular propeller shaft, to provide a substantially direct flow of gas from the propellant chamber through the tubine to an exhaust passage extending through the tubular propeller shaft, nor provided speed reduction gearing interconnecting the turbine wheel and the propeller shaft and with a common mounting for the bearing means for the aforesaid rotating components to provide assured bearing alignment.

The prior art also discloses various mechanisms for achieving directional control of an underwater device including the use of a pair of separatelypositionable fins which can be separately controlled to produce heading changes in any direction of the underwater device. This prior art has not disclosed a pair of fins separately controllable by a pair of fluid cylinders supplied with fluid as controlled by a pair of control valves associated one with each cylinder and with each cylinder having a piston rod and piston, with the piston carrying a rack meshing with a pinion on a rotatable shaft carrying a fin and wherein the fluid cylinders can use hot gas exhausted from a propellant gas chamber which drives the propulsion system of the underwater device and with such a construction fitting into a small space to contribute to the over-all minimum size of the underwater device.

DISCLOSURE OF THE INVENTION

A primary feature of the invention is to provide a new and improved propulsion and directional control mechanism for an underwater device and, more particularly, for a mobile mine which uses a solid propellant as a power source for driving a gas turbine with aft exhaust through the hull of the device and with a minimum over-all length being achieved, in part, by a unique dual control actuation system for a pair of directional control fins.

More particularly, the underwater device has a tail cone with bearing means for rotatably mounting a tubular propeller shaft and the turbine wheel of a gas turbine as well as gearing of a speed-reduction gearbox interconnecting the turbine wheel and the propeller shaft to assure alignment of the bearings of the various components. The axis of rotation of the turbine wheel is offset from the axis of rotation of the propeller shaft wherein gas can flow directly from a gas propellant chamber through the turbine to an exhaust passage extending through the propeller shaft for discharge aft of the device. The gas turbine and the gas propellant chamber share a common wall with nozzles therein for directing flow of gas from the chamber to the turbine wheel.

Additionally, directional control of the underwater device is achieved by structure including a pair of fins mounted at the aft end of the tail cone on a pair of transversely-extending, individually rotatable shafts, each having a pinion. A pair of fluid cylinders are associated one with each of the rotatable shafts and each has a piston with a piston rod extending therefrom having a rack for association with the pinion and with the piston rods extending longitudinally alongside the exhaust passage for the propellant gas. Each of the fluid cylinders may have pressure fluid directed thereto under the control of a pair of control valves associated one with each of the fluid cylinders and with the fluid pressure source either being hot gas exhausted from the propellant gas chamber or hydraulic fluid stored in a hydraulic accumulator.

An object of the invention is to provide a mobile underwater device comprising, propulsion means including a hollow propeller shaft mounting a propeller, a gas turbine having a turbine wheel, a gas propellant chamber having an outlet communicating with the turbine wheel, a gas exhaust passage from the turbine extending through the hollow propeller shaft, and said turbine wheel having its axis of rotation offset from the axis of rotation of the hollow propeller shaft to enable said gas exhaust passage to generally align with the center of said hollow propeller shaft.

Still another object of the invention is to provide a propulsion mechanism as defined in the preceding paragraph wherein said gas propellant chamber and gas turbine share a common wall with gas nozzles extending through said common wall.

A further object of the invention is to provide a mobile underwater device and, more particularly, a mobile mine comprising, directional control means including a pair of movable fins at the aft end of the device, a pair of rotatable shafts extending transversely of said device and each mounting one of said fins, and means for positioning said fins by rotation of said shafts including a pair of fluid cylinders associated one with each of the rotatable shafts and each having a piston and a linearly movable piston rod, and a gear connection between each piston rod and associated rotatable shaft for converting linear movement of the piston rod into movement of a fin.

An additional object of the invention is to provide a mobile mine as defined in the preceding paragraph wherein a pair of control valves are associated one with each fluid cylinder for controlling the position of the pistons and fins and wherein fluid under pressure supplied to the control valves can either be derived from exhaust gas from a gas propellant chamber or hydraulic fluid from a hydraulic accumulator.

An additional object of the invention is to provide a mobile underwater device having a tail cone, a rotatable propeller shaft, a gas turbine having a turbine wheel providing a drive for the propeller shaft, a speed reduction gearbox connected between the turbine wheel and the propeller shaft and bearing means for said propeller shaft, turbine wheel and speed reduction gearbox which are all mounted on said tail cone to achieve alignment of said bearings.

BEST MODES FOR CARRYING OUT THE INVENTION

Figure 1:
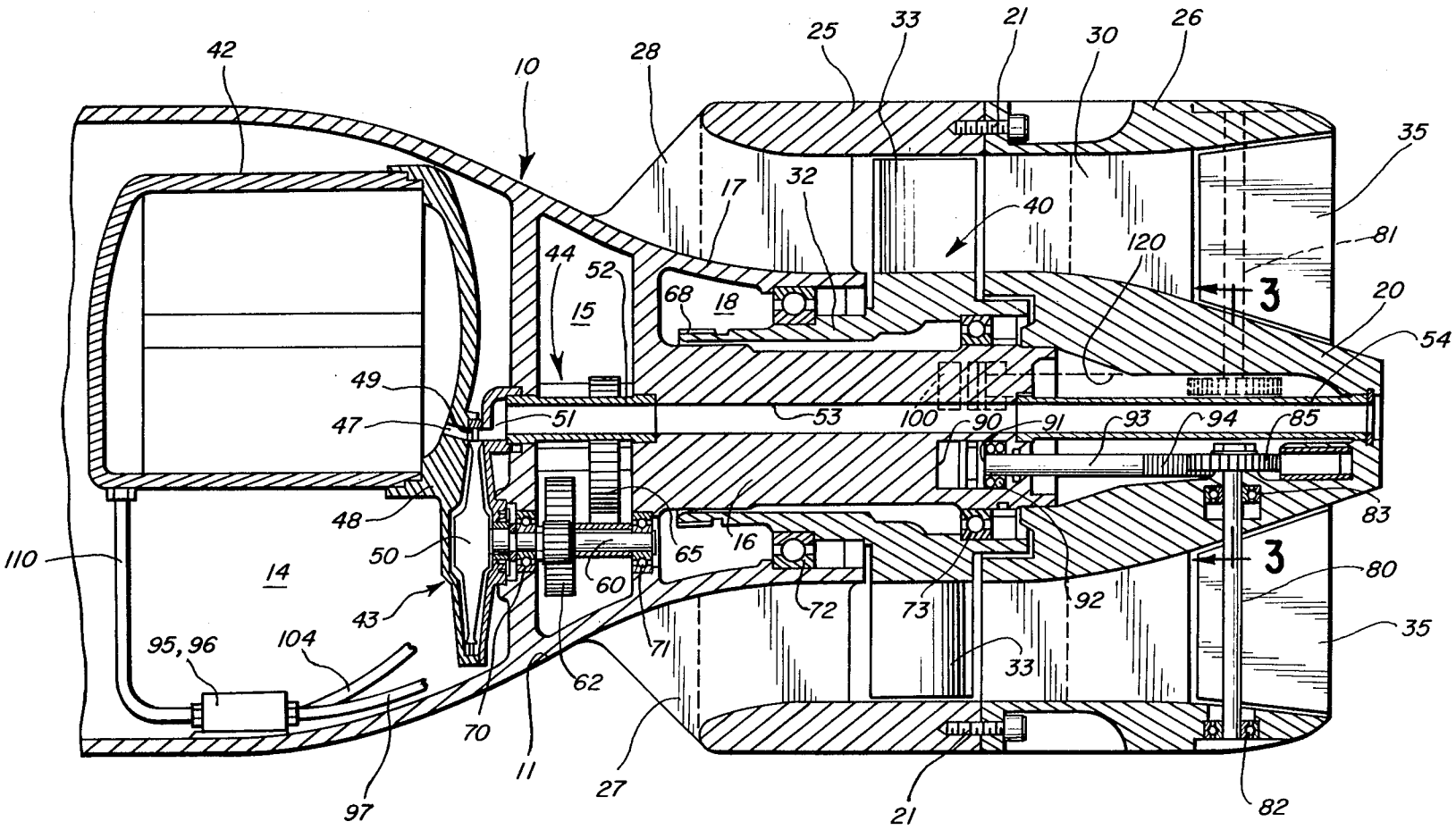
FIG. 1 is a longitudinal central section of the after part of an underwater device, such as a mobile mine.

The underwater device is shown in the form of a mobile mine, with the after part thereof shown in FIG. 1. A tail cone, indicated generally at 10, has a generally frusto-conical front section 11 with a pair of interior chambers 14 and 15 and a generally cylindrical section 16 with an annular surrounding spaced flange 17 defining a chamber 18 therebetween. Additionally, the tail cone 10 has an aft section 20 rigidly associated with the front section 11 by a series of fasteners in the form of threaded bolts 21 which interconnect a pair of annular elements 25 and 26 integral with the tail cone front section 11 and aft section 20. The annular element 25 is formed integral with the tail cone front section 11 by integral inlet guide vanes 27 and 28. The annular element 26 is integrally associated with the tail cone aft section 20 by radially-extending stator and stabilizer structure 30 positioned at a plurality of circumferentially-spaced locations about the tail cone aft section 20.

The space between the body parts of the tail cone front section 11 and aft section 20 and the annular elements 25 and 26 provides an annular channel for flow of water past a propeller 40 having a tubular propeller shaft 32 positioned partly in the chamber 18 and having a plurality of radially-extending blades 33. The inlet guide vanes 27 and 28 as well as additional inlet guide vanes, not seen in FIG. 1, and which are spaced circumferentially about the tail cone front section 11 direct the flow of water past the propeller blades, with the water then flowing through the stator and stabilizer structure 30 and past directional control means in the form of a pair of independently positionable fins 35, discussed more particularly hereinafter.

The propulsion means in addition to the propeller 40 includes a propellant gas chamber or tank 42 mounted in the tail cone chamber 14, a gas turbine 43 also mounted in the chamber 14, and a speed-reduction gearbox, indicated generally at 44, which is positioned in the chamber 15 and drivingly interconnects the gas turbine and the propeller shaft 32.

The gas propellant chamber 42 contains a solid propellant which, when burned, produces a hot gas under pressure which can flow through an outlet 47 to the gas turbine. The propellant chamber 42 and gas turbine 43 share a common wall 48 having nozzles 49 for directing the hot gas from the outlet 47 to a turbine wheel 50 of the gas turbine. The gas exhausts from the gas turbine through a passage 51 to an exhaust passage including a tubular member 52 which communicates with a passage 53 formed in the cylindrical section 16 of the tail cone front section 11 and which, in turn, communicates with a tube 54 opening to the aft end of the tail cone aft section 20. With the tubular propeller shaft 32 surrounding the cylindrical section 16, the exhaust gas effectively exhausts through the propeller shaft.

Figure 2:
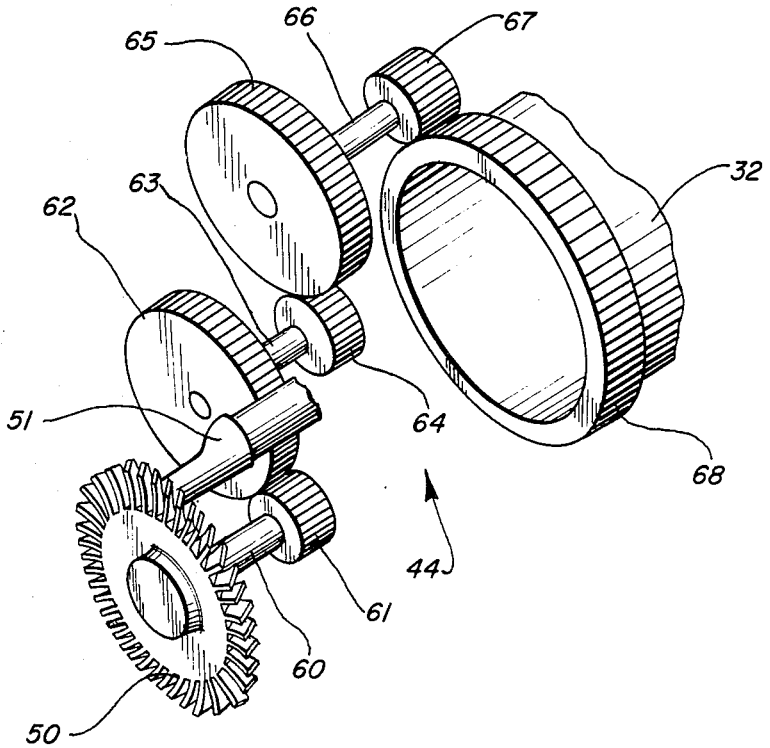
FIG. 2 is a schematic perspective view of the speed reduction gearing between a turbine wheel and a tubular propeller shaft.

The turbine wheel 50 is on a shaft 60 for rotation about an axis offset from the axis of rotation of the propeller shaft 32 to enable substantially straight-through gas flow from the propellant gas chamber 42 to the exhaust passage for discharge aft of the mobile mine. As seen particularly in FIG. 2, the speed-reduction gearbox 44 has three gear meshes to convert gas turbine output to the desired rotational speed for the propeller 40. The turbine wheel shaft 60 has a gear 61 meshing with a gear 62 on a shaft 63, with the latter shaft having a gear 64. The gear 64 meshes with a gear 65 on a shaft 66 having a gear 67 which meshes with an external gear 68 carried on the tubular propeller shaft 32. This drive train is accurately located and avoids the use of a flexible coupling to connect to the propeller shaft by having all of the bearing means for the rotatable components mounted to the unitary tail cone structure. This includes the bearing means 70 and 71 for the turbine wheel shaft 60 as well as the bearing means for the shafts of the speed-reduction gearbox and the bearings 72 and 73 which rotatably mount the propeller shaft 32.

Figure 3:
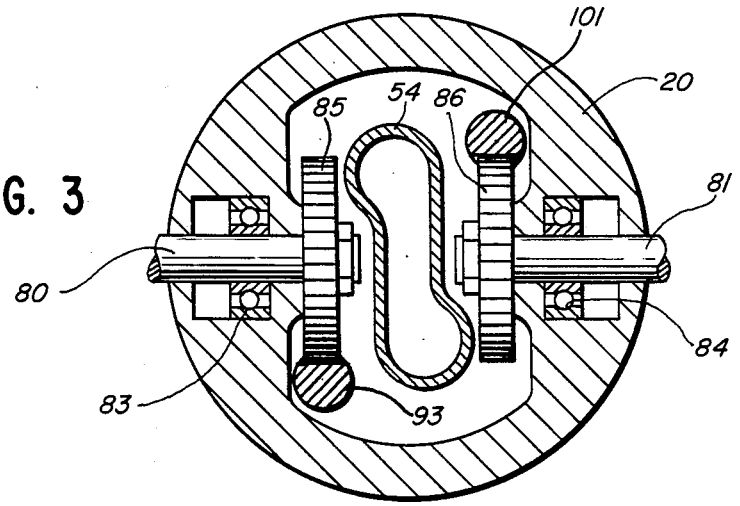
FIG. 3 is a partial section, taken generally along the line 3—3 in FIG. 1 and on an enlarged scale.

The directional control means includes the pair of fins 35, previously referred to, which are individually mounted, one in each of a pair of rotatable shafts 80 and 81 (FIGS. 1 and 3) extending transversely of the mobile mine. Each shaft is rotatably supported by a pair of bearings at opposite ends thereof with the bearings for the shaft 80 being shown at 82 and 83 and the inboard bearing for the shaft 81 being shown at 84. As seen in FIG. 3, the shafts 80 and 81 are in alignment and terminate at their inner ends adjacent the sides of the exhaust member 54 and each shaft mounts a pinion gear 85 and 86, respectively.

The positioning of the fins is controlled by rotative postioning of the shafts 80 and 81 independently of each other and with each shaft being positioned by operating mechanism, including a fluid cylinder. A fluid cylinder 90 is located within the cylindrical section 16 of the tail cone and has a movable piston 91 therein urged in one direction by a spring 92 and having a piston rod 93 extending therefrom having a rack 94 which meshes with the pinion gear 85. Fluid pressure can be applied to the piston 91 in opposition to the force of the spring 92 for positioning of the associated fin under the control of one of a pair of control valves 95 and 96 located within the chamber 14 and having a control fluid line 97 extending to the cylinder 90.

A second fluid cylinder 100 is shown in phantom line in FIG. 1 since, as seen in FIG. 3, it is located above the line along which the sectional view of FIG. 1 is taken. The fluid cylinder 100 has a construction the same as the fluid cylinder 90 with a piston having a piston rod 101 having a rack which coacts with the pinion gear 86. The other of the control valves 95 and 96 controls the delivery of fluid pressure to the fluid cylinder 100 through a fluid control line 104.

Figure 4:
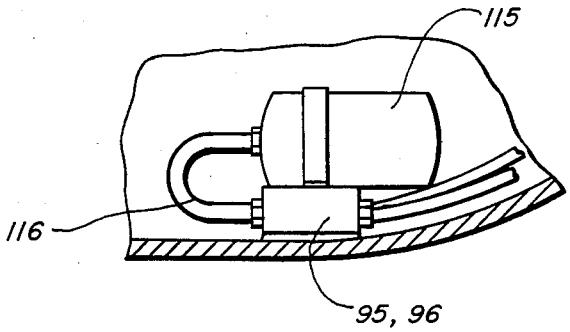
FIG. 4 is a fragmentary view of an alternate source of fluid pressure for the operation of the directional control fins.

The fluid under pressure selectively delivered to the fluid cylinders 90 and 100 under the control of the control valves 95 and 96 is hot gas under pressure generated within the gas propellant chamber 42 and which is delivered to the control valves through a line 110 (FIG. 1). Alternatively, the fluid pressure can be provided by hydraulic fluid and, as seen in FIG. 4, a hydraulic accumulator 115 has hydraulic fluid stored under pressure and which is delivered to the control valves 95 and 96 through a fluid line 116.

The pistons in the fluid cylinders 90 and 100 are individually movable in order to produce heading changes in any direction, by inducing body roll of the mobile mine. With the dual fin construction, the mobile mine will bank as it turns. The fluid cylinders enable the use of exhaust gas from the propellant gas chamber for control of the fins and the use of the piston rods and rack and pinion gear structure enable disposing the directional control mechanism within a small space in an interior chamber 120 in the tail cone aft section 20.

The disclosed mobile mine has minimum overall length and utilizes a hot gas under pressure provided by burning of a solid propellant to achieve propulsion by driving a gas turbine with exhaust aft of the mobile mine through the hull thereof and with dual control of the directional control fins and powering thereof being optionally derived from the same source of gas as used for propulsion.

We claim:

1. A mobile underwater device comprising, directional control means including a pair of movable fins at the aft end of the device, a pair of rotatable shafts extending transversely of said device and each mounting one of said fins, and means for positioning said fins by rotation of said shafts including a pair of fluid cylinders associated one with each of the rotatable shafts and each having a piston and a linearly movable piston rod, and a gear connection between each piston rod and associated rotatable shaft for converting linear movement of the piston rod into movement of a fin.

2. A mobile underwater device as defined in claim 1 including a pair of control valves associated one with each fluid cylinder for controlling the position of the pistons and fins.

3. A mobile underwater device as defined in claim 2 including propulsion means having a gas propellant chamber, and said control valves controlling the flow of propellant gas exhausted from said gas propellant chamber to said fluid cylinders for positioning of said fins.

4. A mobile underwater device as defined in claim 2 including a container of fluid under pressure connected to said control valves for supplying fluid to said fluid cylinders.

5. A mobile mine comprising, directional control means including a pair of fins, a pair of rotatable shafts each mounting one of said fins, means for positioning said fins by rotation of said shafts including a pair of fluid cylinders associated one with each of the rotatable shafts and each having a piston and a piston rod, and a rack and pinion connection between each piston rod and associated rotatable shaft.

6. A mobile mine as defined in claim 5 including a pair of control valves associated one with each fluid cylinder for controlling the position of the pistons and fins.

7. A mobile mine as defined in claim 6 including propulsion means having a gas turbine and a gas propellant chamber, and said control valves controlling the flow of propellant gas exhausted from said gas propellant chamber to said fluid cylinders for positioning of said fins.

8. A mobile mine as defined in claim 6 including a hydraulic accumulator as a source of pressure fluid for said control valves.

9. A mobile underwater device comprising, propulsion means including a hollow propeller shaft mounting a propeller, a gas turbine having a turbine wheel, a gas propellant chamber having an outlet communicating with the turbine wheel, a gas exhaust passage from the turbine extending through the hollow propeller shaft, and said turbine wheel having its axis of rotation offset from the axis of rotation of the hollow propeller shaft to enable said gas exhaust passage to generally align with the center of said hollow propeller shaft.

10. An integrated mobile mine as defined in claim 9 wherein said gas propellant chamber and gas turbine share a common wall with gas nozzles extending through said common wall.

11. A mobile underwater device as defined in claim 9 including a pair of directional control fins, means for positioning said fins comprising a pair of fluid cylinders, and said gas propellant chamber providing a source of gas under pressure for said fluid cylinders.

12. A mobile underwater device as defined in claim 11 including a pair of rotatable shafts extending from opposite sides of the gas exhaust passage and each mounting a directional control fin, a pinion on each shaft, a pair of piston rods extending lengthwise of the mine and each having a rack associated with a pinion, and said pair of fluid cylinders each having a piston connected to a separate one of said piston rods, and means for controlling the delivery of gas under pressure to said fluid cylinders.

13. A mobile mine comprising, a tail cone, a tubular propeller shaft mounting a propeller, bearing means supported by said tail cone for rotatably mounting the propeller shaft, a gas turbine having a turbine wheel, a gas propellant chamber having an outlet communicating with the turbine wheel, a gas exhaust passage from the turbine extending partly through the tubular propeller shaft, and a drive connection between the turbine wheel and the propeller shaft including a speed reduction gearbox with rotatable meshing gears and bearing means supported by the tail cone for mounting the rotatable meshing gears, said turbine wheel having its axis of rotation offset from the axis of rotation of the tubular propeller shaft to enable said gas exhaust passage to generally align with the center of said tubular propeller shaft.

14. A mobile mine as defined in claim 13 wherein said gas propellant chamber and gas turbine share a common wall with gas nozzles extending through said common wall.

15. A mobile mine as defined in claim 13 including a pair of individually movable directional control fins, a pair of rotatable shafts extending from opposite sides of the gas exhaust passage and each mounting a fin, a pinion on each shaft, a pair of piston rods extending lengthwise and at opposite sides of the gas exhaust passage and each having a rack associated with one of said pinions, a pair of fluid cylinders each having a piston connected to a separate one of said piston rods, and means for controlling the delivery of pressure fluid to said fluid cylinders.

16. A mobile mine as defined in claim 15 wherein said means for controlling the delivery of pressure fluid comprises a pair of valves.

17. A mobile mine as defined in claim 16 wherein said pressure fluid is gas from said gas propellant chamber.

18. A mobile mine as defined in claim 16 wherein a hydraulic accumulator is the source of pressure fluid.

19. An underwater device comprising, a tail cone, a rotatable propeller shaft, a gas turbine having a turbine wheel providing a drive for the propeller shaft, a speed reduction gearbox connected between the turbine wheel and the propeller shaft and bearing means for said propeller shaft, turbine wheel and speed reduction gearbox which are all mounted on said tail cone to achieve alignment of said bearings.

20. A device as defined in claim 19 including a propellant gas chamber for delivering gas to the gas turbine, and said turbine wheel having its axis of rotation offset from the axis of rotation of the propeller shaft to enable gas to exhaust from the turbine at a location generally in line with the axis of rotation of the propeller.

21. A device as defined in claim 20 wherein said propeller shaft is tubular, and said gas exhausted from the turbine flows through said tubular propeller shaft.

22. A device as defined in claim 20 wherein said propellant gas chamber and gas turbine share a common wall with nozzles formed in said wall for flow of gas to said gas turbine.

* * * * *